US009901231B2

(12) United States Patent
Tibberts

(10) Patent No.: US 9,901,231 B2
(45) Date of Patent: Feb. 27, 2018

(54) COMBINATION VACUUM AND TOWELETTE MOP

(71) Applicant: Janet Lynn Tibberts, Greenwich, CT (US)

(72) Inventor: Janet Lynn Tibberts, Greenwich, CT (US)

( * ) Notice: Subject to any disclaimer, the term of this patent is extended or adjusted under 35 U.S.C. 154(b) by 14 days.

(21) Appl. No.: 15/143,291

(22) Filed: Apr. 29, 2016

(65) Prior Publication Data

US 2017/0311768 A1 Nov. 2, 2017

(51) Int. Cl.

| | |
|---|---|
| ***A47L 11/282*** | (2006.01) |
| ***A47L 9/04*** | (2006.01) |
| ***A47L 7/02*** | (2006.01) |
| ***A47L 9/06*** | (2006.01) |
| ***A47L 9/14*** | (2006.01) |

(52) U.S. Cl.

CPC ..... *A47L 9/0488* (2013.01); *A47L 7/02* (2013.01); *A47L 9/0477* (2013.01); *A47L 9/0653* (2013.01); *A47L 9/1409* (2013.01)

(58) Field of Classification Search

CPC ..... A47L 9/0488; A47L 7/02; A47L 9/0477; A47L 9/0653; A47L 9/1409; A47L 11/4047; A47L 11/4069; A47L 11/4083

See application file for complete search history.

(56) References Cited

U.S. PATENT DOCUMENTS

| | | | | |
|---|---|---|---|---|
| 1,310,296 | A * | 7/1919 | Rogers | A47L 11/4047 15/51 |
| 4,369,544 | A * | 1/1983 | Parisi | A47L 11/30 15/320 |
| 4,570,278 | A * | 2/1986 | Bloome | A47L 11/185 15/230 |
| 4,845,794 | A * | 7/1989 | Korski | A47L 11/292 15/320 |
| 5,241,724 | A | 9/1993 | Lim | |
| 5,287,581 | A * | 2/1994 | Lo | A47L 11/292 15/230 |
| 6,859,976 | B2 | 3/2005 | Plankenhorn | |
| 2001/0042282 | A1 * | 11/2001 | Sjogreen | A47L 9/0477 15/322 |

* cited by examiner

*Primary Examiner* — Dung Van Nguyen

(74) *Attorney, Agent, or Firm* — LaMorte & Associates, P.C.

(57) ABSTRACT

An improved cleaning head for a vacuum assembly. The cleaning head has a body with a bottom surface. Within the cleaning head is at least one suction channel that leads into a vacuum cleaner. A first rotating brush is mounted to the body of the cleaning head in front of a suction channel. A towelette support is mounted within the body adjacent the first rotating brush. The towelette support is configured to receive a disposable towelette. A second rotating brush may also be provided, wherein the towelette support would be interposed between the first and second rotating brushes. A mechanism is provided for selectively moving the towelette support within the body between an extended position and a retracted position.

18 Claims, 6 Drawing Sheets

COMBINATION VACUUM AND TOWELETTE MOP

BACKGROUND OF THE INVENTION

1. Field of the Invention

In general, the present invention relates to the structure of both vacuum cleaners and mops that retain disposable towelettes. More particularly, the present invention relates to cleaning implements that combine the features of vacuum cleaners with the features of mops.

2. Prior Art Description

Most homes in the United States have rooms with different flooring surfaces. Rooms, such as the kitchen and bathroom, typically have hard surface flooring, such as tiled flooring, hardwood flooring, or laminate flooring. Rooms, such as bedrooms and living rooms, typically have carpeting in the form of either area rugs or wall-to-wall carpeting. As will be understood by any homeowner, these different flooring surfaces are cleaned in different ways.

Carpeted floors are typically vacuumed for cleaning. Occasionally, stains are scrubbed out of the carpeting. However, for most day to day cleaning, only a vacuum cleaner is used. Vacuum cleaners for use on carpeting traditionally contain spinning brushes that agitate the carpeting and loosen the dirt. The loosened dirt is then drawn away by the vacuum cleaner. Conversely, hard flooring requires many steps to be cleaned. First, the floor needs to be swept by a broom or vacuumed to remove loose dirt. If swept, the dirt, dust, and hair needs to be swept into a dustpan and then emptied into a trashcan. Second, a suitable mop must be used to remove stationary dirt and restore a shine to the flooring. To remove dirt that is not loose, hard floors are typically cleaned with soap and water. Wood floors need to be cleaned with wood soaps. Tiled floors might need to be cleaned with both a soap and a bleach product.

Accordingly, when a person is trying to clean a house, depending on how many floors of the house there are to be cleaned, that person may need to carry a vacuum cleaner, a broom, a dustpan, a mop, a bucket full of water, and a variety of cleaning solutions. All of these cleaning tools must be maintained and stored somewhere in the house. The vacuum cleaner, mop, bucket, and broom and associated cleaning products may even require their own closet or small room. Many houses do not have enough extra storage space to accommodate the full collection of cleaning supplies. As such, different cleaning implements, such as the vacuum cleaner, broom and mop are stored in different locations. The gathering and storage of the all the cleaning implements adds significantly to the overall labor of cleaning the house.

Heavy mops are not always required to wipe down hard flooring surfaces. Rather, to simplify the cleaning procedure, companies have developed and marketed lightweight mops that retain disposable pads. With a disposable pad mop, a moist towelette is attached to a lightweight handle. The towelette can then be passed over a floor to wipe up or sanitize the floor. The towelette is then discarded. Although the use of disposable pad mops eliminates the need for buckets of water and heavy mops, it does not eliminate the need for a broom or a vacuum cleaner.

In the prior art, designs have been created that combine the structure of a disposable pad mop with the structure of a broom or a vacuum cleaner. U.S. Pat. No. 6,859,976 to Plankenhorn shows a system that combines a mechanical broom with a pad mop. U.S. Pat. No. 5,241,724 to Lim discloses a system that combines an electric vacuum cleaner with a pad mop. However, such prior art systems share the same drawback. That is, in the prior art systems, the pad mop is constantly in contact with the floor as the broom sweeps or the vacuum cleaner advances. As such, prior art systems with combine pad mops with brooms or vacuum cleaners can only be used on hard floor surfaces. If such prior art systems were pushed over a carpet, the pad would contact the carpet and either tear or become dislodged. Accordingly, even if such prior art systems were used, a person cleaning a house would still have to bring a standard vacuum cleaner so that the carpets could be cleaned.

A need therefore exists for system that combines a disposable pad mop with a vacuum cleaner in a manner that the system can be used to effectively clean both carpets and hard floor surfaces. This need is met by the present invention as described and claimed below.

SUMMARY OF THE INVENTION

The present invention is an improved cleaning head for a vacuum assembly. The head can be the floor head or an auxiliary hose head. The cleaning head has a body with a bottom surface. The bottom surface of the cleaning head is positioned adjacent a surface that is to be cleaned. Within the cleaning head is at least one suction channel that leads into a vacuum cleaner.

A first rotating brush is mounted to the body of the cleaning head in front of a suction channel. In this manner, any loose material displaced by the rotating brush is drawn away. A towelette support is mounted within the body adjacent the first rotating brush. The towelette support is configured to receive a disposable towelette. A second rotating brush may also be provided, wherein the towelette support would be interposed between the first and second rotating brushes.

A mechanism is provided for selectively moving the towelette support within the body between an extended position and a retracted position. In this manner, the towelette support and towelette can be retracted when passing over carpet and extended when passing over hard flooring.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention assembly can be embodied in many ways, the assembly illustrated shows only one exemplary embodiment. The exemplary embodiment is selected in order to set forth one of the best modes contemplated for the invention. The illustrated embodiment, however, is merely exemplary and should not be considered a limitation when interpreting the scope of the appended claims.

Figure 1:
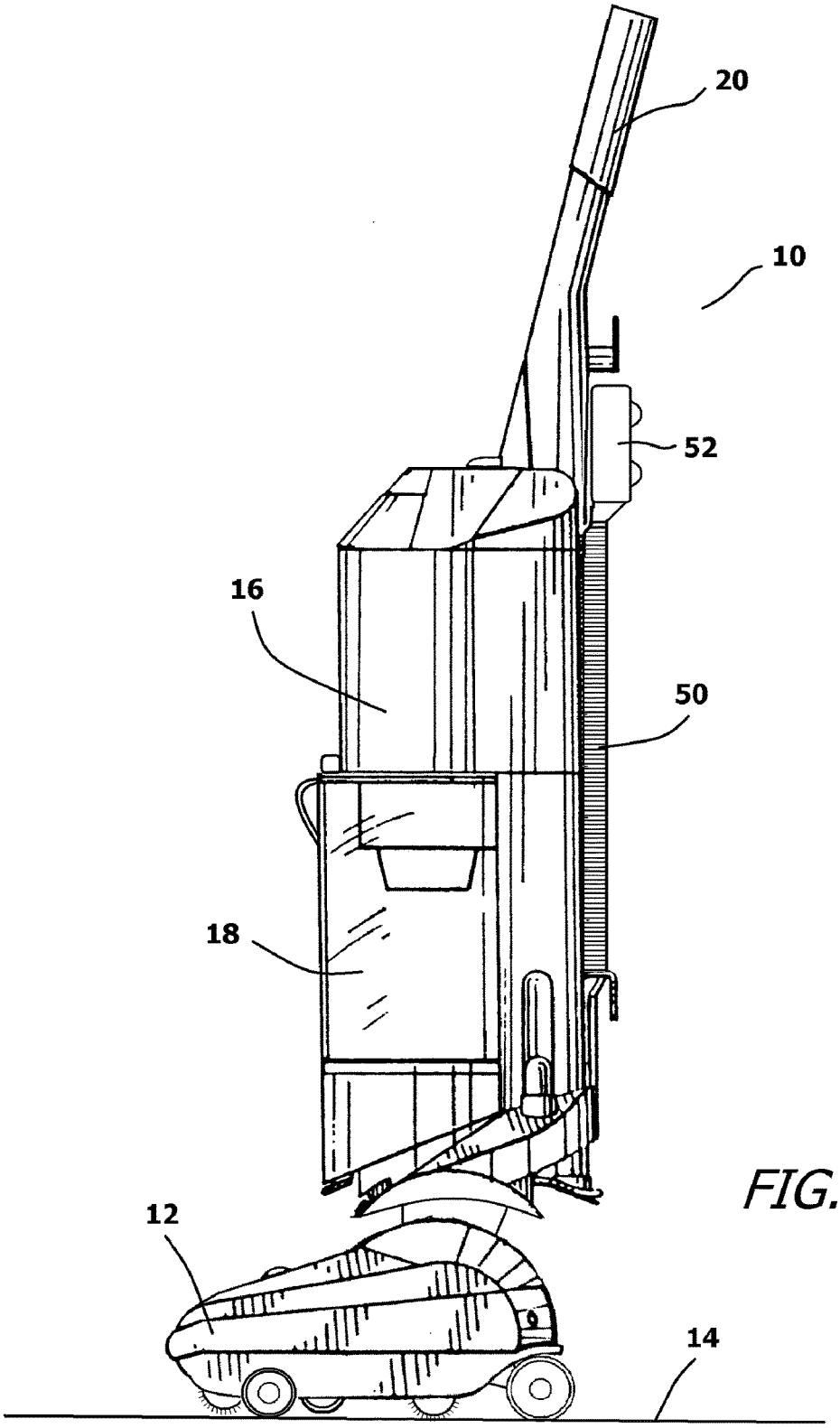
FIG. 1 is a side view of an exemplary embodiment of a vacuum assembly in accordance with the present invention.

Referring to FIG. 1, a vacuum assembly 10 is shown. The vacuum assembly 10 combines features of a traditional vacuum cleaner with features of a pad mop. The vacuum assembly 10 has a floor head 12 that rolls along the surface of the floor 14. As the floor head 12 passes over loose dirt and debris, the loose material is drawn up through the floor head 12 and into the tower 16 of the vacuum assembly 10. The suction is created by a powered fan assembly (not shown) mounted within the tower 16. Within the tower 16, the dirt and debris is deposited in a removable canister 18. The vacuum assembly 10 is moved about by a person manipulating a handle 20 that extends from the tower 16.

Figure 2:
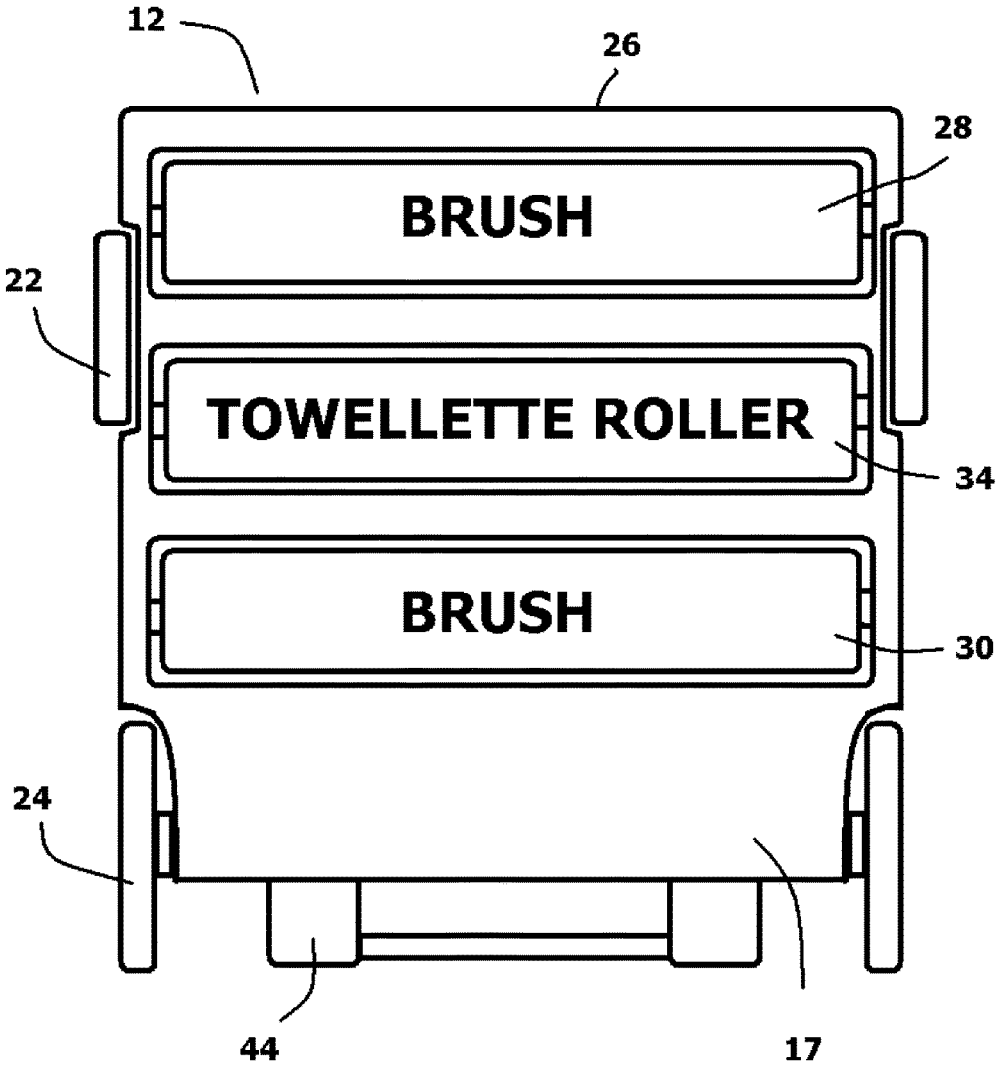
FIG. 2 is a bottom view of the floor head component of the vacuum assembly.
Figure 3:
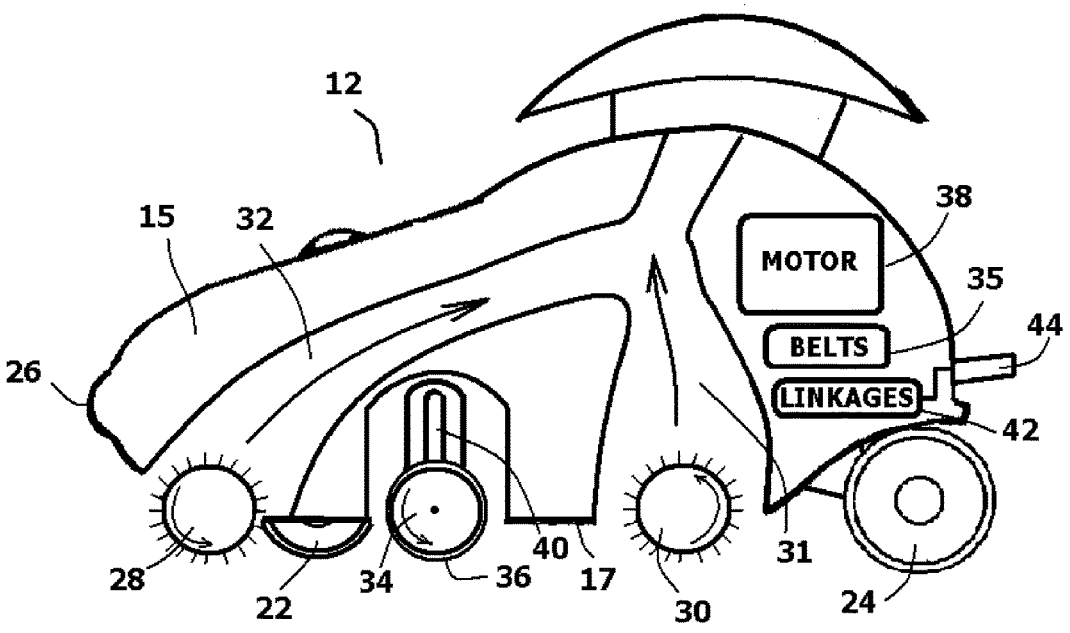
FIG. 3 is a side schematic showing the major components within the floor head of the vacuum assembly, wherein the support roll for the towelette is in its extended position.

Referring to FIG. 2 and FIG. 3 in conjunction with FIG. 1, some details of the floor head 12 are shown. The floor head 12 has a body 15 that rolls upon wheels. The wheels include a forward set of wheels 22 and a rearward set of wheels 24. The rearward set of wheels 24 are the furthest rearward part of the floor head 12. The rearward wheels 24 are also, preferably, the larger diameter wheels. In this manner, the vacuum assembly 10 can be readily tilted onto just the rearward wheels 24, when being transported from place to place.

The body 15 of the floor head 12 has a front edge 26. The forward wheels 22 are set back from the front edge 26 of the body 15. The purpose of this set back is later described. When the floor head 12 rests upon the forward wheels 22 and the rearward wheels 24, the entire vacuum assembly 10 is free standing. Furthermore, as a person grabs and manipulates the handle 20, the vacuum assembly 10 can roll upon the wheels 22, 24. In the shown embodiment, the forward wheels 22 and the rearward wheels 24 are fixed wheels. Although such a configuration is preferred, it will be understood that the forward wheels 22 and the rearward wheels 24 can be replaced by caster wheels or rollers, to provide more freedom of movement.

Two rotating brushes 28, 30 are disposed within the floor head 12. The two rotating brushes include a front rotating brush 28 and a rear rotating brush 30. The two rotating brushes 28, 30 extend across the width of the floor head 12 and protrude from the bottom surface 17 of the floor head 12. The front rotating brush 28 is located in the mouth of a front suction channel 32. Likewise, the rear rotating brush 30 is located in the mouth of a rear suction channel 31. Accordingly, any dirt or debris agitated by the two rotating brushes 30, 32 will be sucked into the vacuum assembly 10 and deposited into the canister 18.

The front rotating brush 28 is positioned in front of the forward wheels 22. In this manner, the front rotating brush 28 is closer to the front edge 26 of the floor head 12 than are the forward wheels 22. In this manner, when the floor head 12 is rolled forward toward a wall or other obstacle, the suction draw around the front rotating brush 28 can draw dirt and debris resting against the wall in a manner unencumbered by the forward wheels 22.

A support roller 34 is disposed between the front rotating brush 28 and the rear rotating brush 30. The support roller 34 is parallel to both the front rotating brush 28 and the rear rotating brush 30. The support roller 34 has an outer diameter. The outer diameter of the support roller 34 is covered with a replaceable and disposable towelette 36.

The front rotating brush 28, the rear rotating brush 30 and the interposed support roller 34 are all rotated by a motor 38 contained within the floor head 12. The motor 38 turns the front rotating brush 28, the rear rotating brush 30 and the support roller 34 using flexible drive belts 35. The towelette 36 can be made cylindrical or flat. If flat, the towelette 36 is wrapped around the support roller 34. Since the support roller 34 and surrounding towelette 36 are interposed between the front rotating brush 28 and the rear rotating brush 30, it will be understood that the towelette 36 will only pass over a segment of the floor 14 that has previously been passed over by one of the rotating brushes 28, 30. As such, any loose dirt or material that is present on the floor 14 will be drawn away by the rotating brushes 28, 30. This prevents any loose dirt or debris from prematurely soiling the towelette 36. This significantly increases the functional life in which the towelette 36 cleans before it needs to be replaced.

In FIG. 2, it can be seen that as the forward and rearward wheels 22, 24 are resting upon a floor 14, the front and rear rotating brushes 28, 30 are positioned to brush the surface of the floor 14. Likewise, the towelette 36 and its internal support roller 34 are so disposed that the towelette 36 wipes the surface of the floor 14. In this manner, if the floor head 12 is rolling upon a hard floor surface, such as a hardwood surface, a laminate surface, or a tile surface, the rotating brushes 28, 30 will brush the surface. The vacuum draw will remove any dirt or debris displaced by the rotating brushes 28, 30. Lastly, the towelette 36 will wipe the surface of the floor 14.

The support roller 34 that supports the towelette 36 is set between two slotted guides 40. The support roller 34 can be adjusted vertically within the slotted guides 40. The vertical position of the support roller 34 is manually controlled using mechanical linkages 42 that are attached to a foot lever 44. In this manner, by pressing the foot lever 44 with the user's foot, a user can change the position of the support roller 34 from the extended position of FIG. 3 to the retracted position of FIG. 4 and back again.

Figure 4:
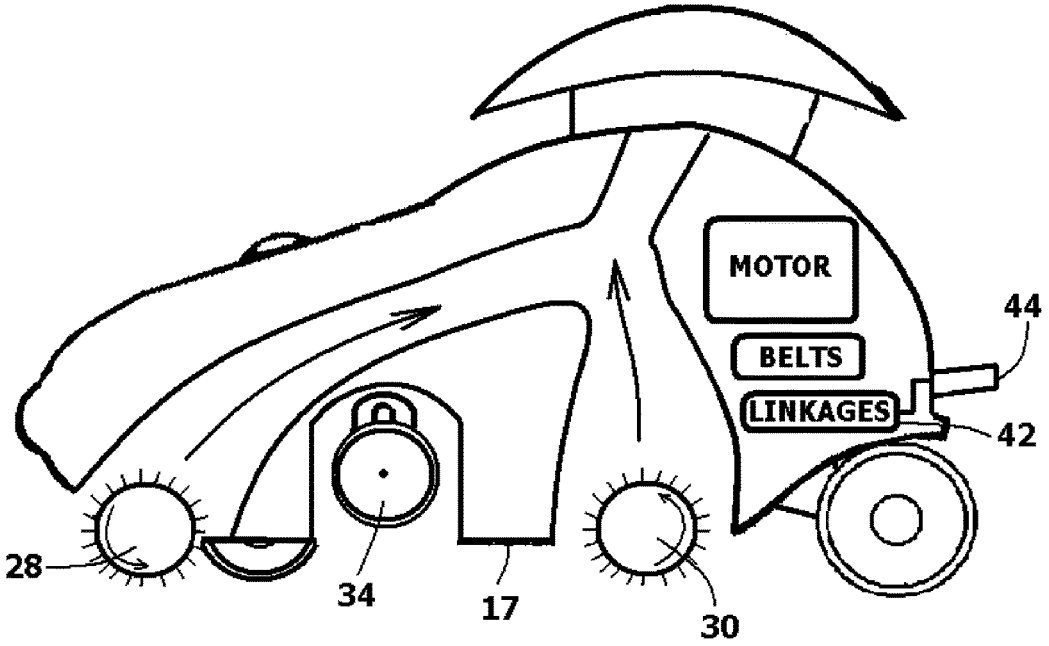
FIG. 4 is a side schematic showing the major components within the floor head of the vacuum assembly, wherein the support roll for the towelette is in its retracted position.

Referring to FIG. 4 in conjunction with FIG. 3, it can be seen that when the support roller 34 is raised into its retracted position, the towelette 36 around the support roller 34 is lifted out of contact with the underlying surface of the floor 14 and retracted above the bottom surface 17. However, the wheels 22, 24 and the rotating brushes 28, 30 remain in contact with the floor 14. This configuration is used when the floor head 12 is rolled over carpeting. If a user is pushing the vacuum assembly 10 from a hard floor surface to a carpeted floor surface, the user presses the foot lever 44. This lifts the support roller 34 and the towelette 36 out of contact with the carpeting. However, the rotating brushes 28, 30 remain in contact with the carpeting. The vacuum assembly 10 then functions as a traditional vacuum cleaner that agitates the carpeting with rotating brushes 28, 30 and sucks away loosened dirt or debris.

Figure 5:
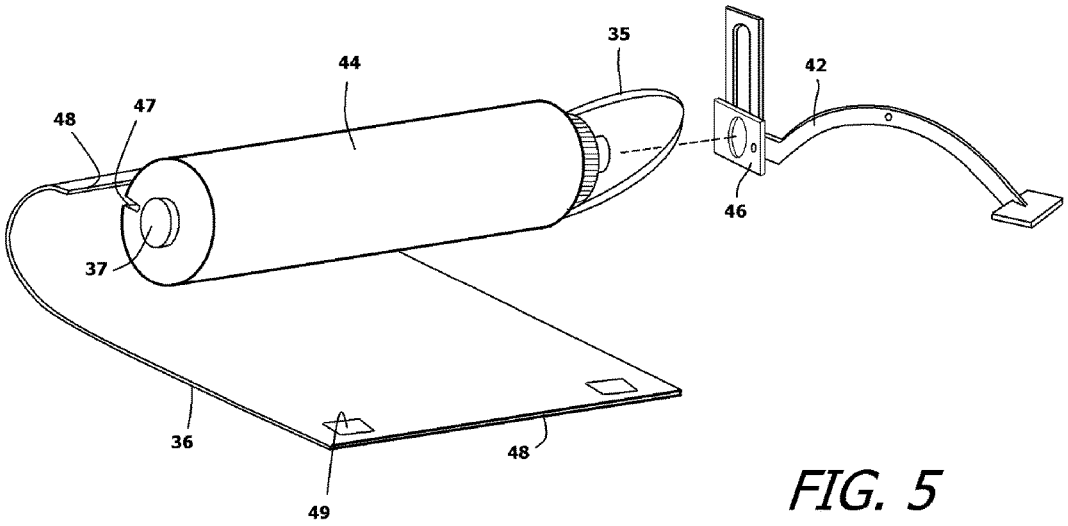
FIG. 5 shows a perspective view of the support roller and mounting features.

Referring now to FIG. 5 in conjunction with FIG. 4, it can be seen that the support roller 34 is rotated by a drive belt 35. Furthermore, the support roller 34 has an axle 37 that engages a retainer 46. The retainer 46 can be raised and lowered by the mechanical linkages 42 that lead to the foot lever 44. The retainer 42 has a quick release design that enables a person to rapidly remove the support roller 34 from the floor head 12 so that the towelette 36 can be replaced. The towelette 36 is wrapped around the support roller 34. The towelette 36 can be affixed to the roller in a number of ways. In the shown embodiment, a slot 47 is formed along the length of the support roller 34 that can receive the two end edges 48 of the towelette 36. This keeps the edges 48 of the towelette 36 protected and prevents the edges 48 from snagging and pulling the towelette 36 from the support roller 34. In addition, the towelette 36 may contain tacky material and/or hook and loop material 49 that enables the interior of the towelette to engage the exterior of the support roller 34.

Figure 6:
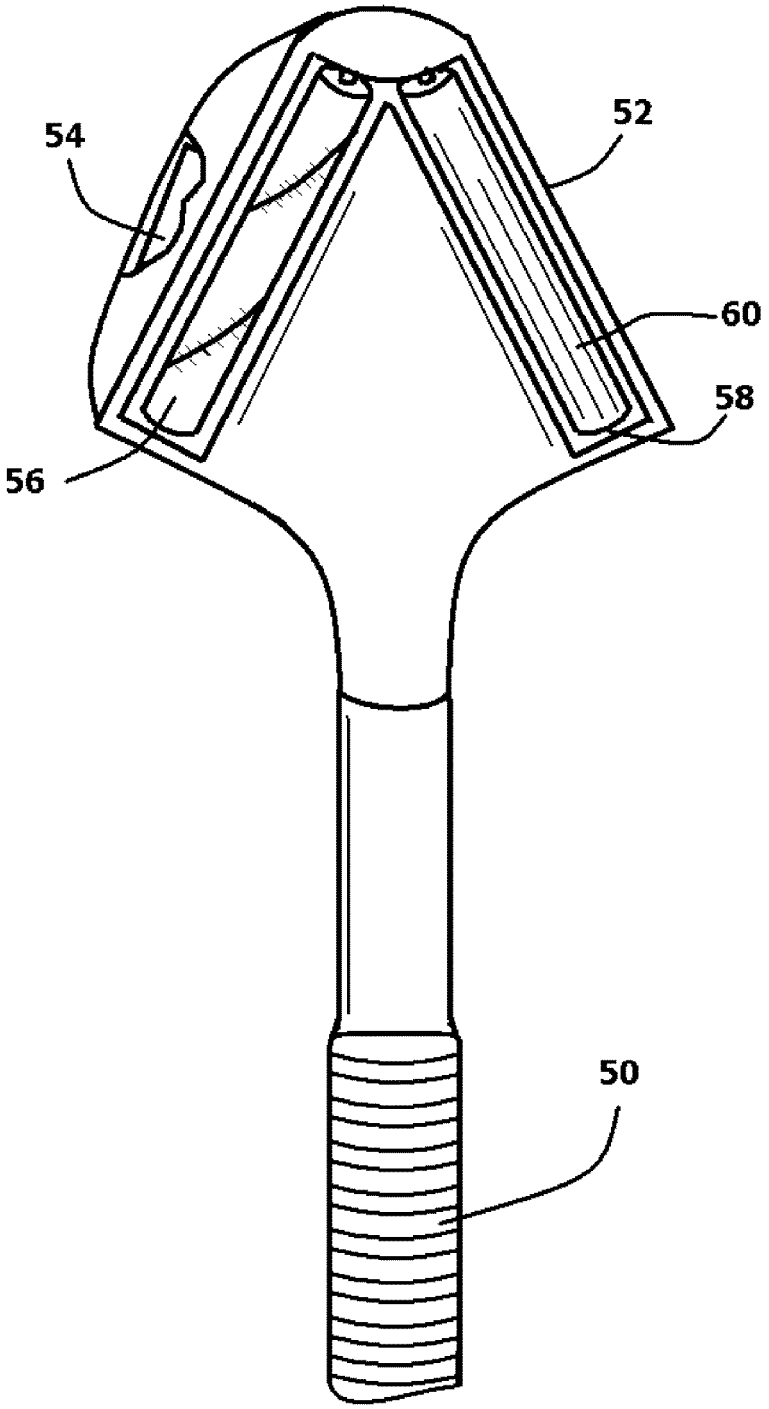
FIG. 6 shows a bottom view of a cleaning head that extends by a hose from the vacuum assembly.

Referring now to FIG. 6 in conjunction with FIG. 1, it can be seen that the vacuum assembly 10 has an extendable hose 50 for use in cleaning steps, furniture, and other objects other than floors. The extendable hose 50 terminates with a cleaning head 52. The cleaning head 52 has a triangular shape. However, other polygonal peripheral shapes can also be used. Within the cleaning head 52 is a small motor 54. The motor 54 turns two elements within the cleaning head 52. The first element turned by the motor 54 is a small rotating brush 56. The rotating brush 56 extends along the length of one edge of the cleaning head 52. The second element turned by the motor 54 is a small support roller 58 around which is wrapped a disposable towelette 60.

The cleaning head 52 has a handle 62 that enables the cleaning head 52 to be easily grasped and manipulated. A user can move the cleaning head 52 so that the rotating brush 56 first passes over an area. This will remove any loose dirt or debris in the area. The user can then change the orientation of the cleaning head 52 so that the towelette 60 passes over that same area. The towelette 60 wipes the area and cleans any remaining residual dirt.

Referring to all figures, it will be understood that the vacuum assembly 10 can suck away loose dirt in the manner of a traditional vacuum cleaner and can wipe way dirt in the manner of a pad mop. However, the features are combined into a single assembly. By placing the features in a single assembly, unexpected synergistic effects can be had. By placing the towelette in between two rotating brushes, the towelette is prevented from coming into contact with large amounts of loose dirt or debris. As such, the towelette is reserved to wipe away only matter that is stuck to the surface of the floor. This significantly extends the useful life of the towelette. As such, the towelette of the present invention does not need to be changed nearly as often as towelettes in traditional pad mops. Furthermore, by placing the towelette onto a support roller that spins, the towelette can be made far more effective in cleaning. The relative movement of the spinning towelette enables the towelette to lift tough stains from hard floor surfaces.

It will be understood that the embodiment of the present invention that is illustrated and described is merely exemplary and that a person skilled in the art can make many variations to that embodiment. For instance, the shape of the vacuum assembly and the floor head can be altered to many designs. Likewise, the features of the invention can be incorporated into many existing vacuum cleaner designs. All such embodiments are intended to be included within the scope of the present invention as defined by the claims.

What is claimed is:

1. A cleaning head for a vacuum assembly, comprising:
- a body having a bottom surface, wherein said bottom surface is positioned adjacent a surface to be cleaned;
- a first suction channel that extends through said body, wherein said first suction channel defines a first open mouth on said bottom surface of said body;
- a first rotating brush mounted in said first open mouth;
- a support roller mounted in said body adjacent said first rotating brush, wherein said support roller is configured to receive a disposable cover; and
- a mechanism for selectively moving said support roller within said body between an extended position and a retracted position.

2. The assembly according to claim 1, further including wheels that support said body.

3. The assembly according to claim 1, further including a second suction channel that extends through said body, wherein said second suction channel defines a second open mouth on said bottom surface of said body, wherein a second rotating brush is mounted in said second open mouth.

4. The assembly according to claim 3, wherein said support roller is interposed between said first rotating brush and said second rotating brush.

5. The assembly according to claim 4, wherein said first rotating brush, said second rotating brush and said support roller are arranged in parallel.

6. The assembly according to claim 1, further including a motor for rotating both said first rotating brush and said support roller.

7. The assembly according to claim 1, wherein said mechanism for selectively moving said support roller includes a foot lever that extends from said body.

8. The assembly according to claim 1, wherein when in said extended position, said support roller partially extends from said body beyond said bottom surface and when in said retracted position said support roller is retracted within said body.

9. An assembly that moves along a surface in order to clean said surface, said assembly comprising:
- a body having a bottom surface, wherein said bottom surface is positioned adjacent a surface to be cleaned;
- a first suction channel that extends through said body,
- a first rotating brush extending from said bottom surface;
- a support roller extending from said bottom surface, wherein said support roller is configured to receive and retain a disposable cover;
- a mechanism for selectively moving said support roller within said body between an extended position and a retracted position; and
- a motor within said body for rotating both said first rotating brush and said support roller.

10. The assembly according to claim 9, wherein said first suction channel defines a first open mouth and said first rotating brush is mounted within said first open mouth.

11. The assembly according to claim 9, wherein when in said extended position, said support roller partially extends from said body beyond said bottom surface, and when in said retracted position said support roller is retracted within said body.

12. The assembly according to claim 9, further including wheels that support said body.

13. The assembly according to claim 9, further including a second suction channel that extends through said body, wherein said second suction channel defines a second open mouth on said bottom surface of said body, wherein a second rotating brush is mounted in said second open mouth.

14. The assembly according to claim 13, wherein said support roller is interposed between said first rotating brush and said second rotating brush.

15. The assembly according to claim 14, wherein said first rotating brush, said second rotating brush and said support roller are arranged in parallel.

16. A cleaning head for a vacuum assembly, comprising:
- a body having a bottom surface, wherein said bottom surface is positioned adjacent a surface to be cleaned;

a first suction channel that extends through said body, wherein said first suction channel defines a first open mouth on said bottom surface of said body;

a first rotating brush mounted in said first open mouth;

a towelette support mounted in said body adjacent said first rotating brush, wherein said towelette support is configured to receive and retain a disposable towelette; and a mechanism for selectively moving said towelette within said body between an extended position and a retracted position.

17. The assembly according to claim 16, further including a second suction channel that extends through said body, wherein said second suction channel defines a second open mouth on said bottom surface of said body, wherein a second rotating brush is mounted in said second open mouth.

18. The assembly according to claim 17, wherein said towelette support is interposed between said first rotating brush and said second rotating brush.

* * * * *